US009174464B2

(12) United States Patent
Tu et al.

(10) Patent No.: US 9,174,464 B2
(45) Date of Patent: Nov. 3, 2015

(54) SUBLIMATION PRINTER

(71) Applicant: HITI DIGITAL, INC., New Taipei (TW)

(72) Inventors: Chun-Chang Tu, New Taipei (TW); Chien-Lin Lee, New Taipei (TW)

(73) Assignee: Hiti Digital, Inc., New Taipei (TW)

( * ) Notice: Subject to any disclaimer, the term of this patent is extended or adjusted under 35 U.S.C. 154(b) by 0 days.

(21) Appl. No.: 14/526,409

(22) Filed: Oct. 28, 2014

(65) Prior Publication Data

US 2015/0116443 A1 Apr. 30, 2015

Related U.S. Application Data

(60) Provisional application No. 61/897,231, filed on Oct. 30, 2013.

(30) Foreign Application Priority Data

Aug. 29, 2014 (TW) ..... 103129951 A

(51) Int. Cl.

| | |
|---|---|
| ***B41J 13/10*** | (2006.01) |
| ***B41J 11/04*** | (2006.01) |
| ***B41J 2/32*** | (2006.01) |

(52) U.S. Cl.

CPC .. *B41J 11/04* (2013.01); *B41J 2/32* (2013.01); *B41J 13/103* (2013.01)

(58) Field of Classification Search

USPC ..... 347/171, 172, 174, 176, 214; 400/207, 400/208, 208.1

See application file for complete search history.

(56) References Cited

U.S. PATENT DOCUMENTS 5,005,998 A * 4/1991 Takanashi et al. ..... 400/208

* cited by examiner

*Primary Examiner* — Huan Tran

(74) *Attorney, Agent, or Firm* — Blakely, Sokoloff, Taylor & Zafman LLP

(57) ABSTRACT

A sublimation printer includes a casing, a platen roller, a thermal printing head and a paper cassette. The platen roller, the thermal printing head and the paper cassette are disposed inside the casing. The platen roller is configured to support a printing medium when the printing medium moves along a first direction or a second direction, in which the first direction is opposite to the second direction. The thermal printing head faces to the platen roller and is used to transfer dyes of a ribbon onto the printing medium. The paper cassette is located on a side of the platen roller along the second direction and is configured to accommodate the printing medium, in which the orthogonal projections of the paper cassette and the platen roller on the casing at least partially overlap with each other.

8 Claims, 5 Drawing Sheets

SUBLIMATION PRINTER

RELATED APPLICATIONS

This application claims priority to U.S. Provisional Application No. 61/897,231 filed on Oct. 30, 2013, and to Taiwan Application Serial Number 103129951, filed on Aug. 29, 2014, which is herein incorporated by reference.

BACKGROUND

1. Field of Invention

The present invention relates to a printer, and more particularly, to a sublimation printer.

2. Description of Related Art

Generally speaking, color printers can be divided into four types: dot matrix printers, inkjet printers, laser printers and sublimation printers. A sublimation printer uses a thermal printing head to heat up a ribbon so that dyes on the ribbon can be transferred onto a printing medium, and a continuous tint can be formed by controlling the heating temperature or length of heating time. The performance of the tint has continuity, and the sublimation printer can print a photo, for example, with more natural colors. Thus, a sublimation printer is adapted to specializing in printing the photos captured by a digital camera and has gained more and more attention by the market due to its excellent printing quality.

As technology advances, the act of shoot and print has gradually become the trend of the market. Therefore, for printing a picture right after shooting, the size of the sublimation printer needs to be minimized to meet the market requirements.

SUMMARY

According to one or more embodiments of the disclosure, a sublimation printer is provided. The sublimation printer includes a casing, a platen roller, a thermal printing head and a paper cassette. The platen roller, the thermal printing head and the paper cassette are disposed inside the casing. The platen roller is configured to support a printing medium when the printing medium moves along a first direction or a second direction, in which the first direction is opposite to the second direction. The thermal printing head faces the platen roller and the thermal printing head is configured to transfer dyes of a ribbon onto the printing medium. The paper cassette is located on a side of the platen roller along the second direction, and the paper cassette is configured to accommodate the printing medium, in which along the first direction or the second direction, an orthogonal projection of the paper cassette on the casing at least partially overlaps with an orthogonal projection of the platen roller on the casing.

As a result, because the paper cassette of one or more embodiments of the present disclosure is disposed on a side of the platen roller and the thermal printing head horizontally, i.e. along the second direction, the thickness of the casing only needs to accommodate the platen roller and the thermal printing head, and the thickness of the casing does not need to increase to accommodate the paper cassette, so as to reduce the thickness of the sublimation printer.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
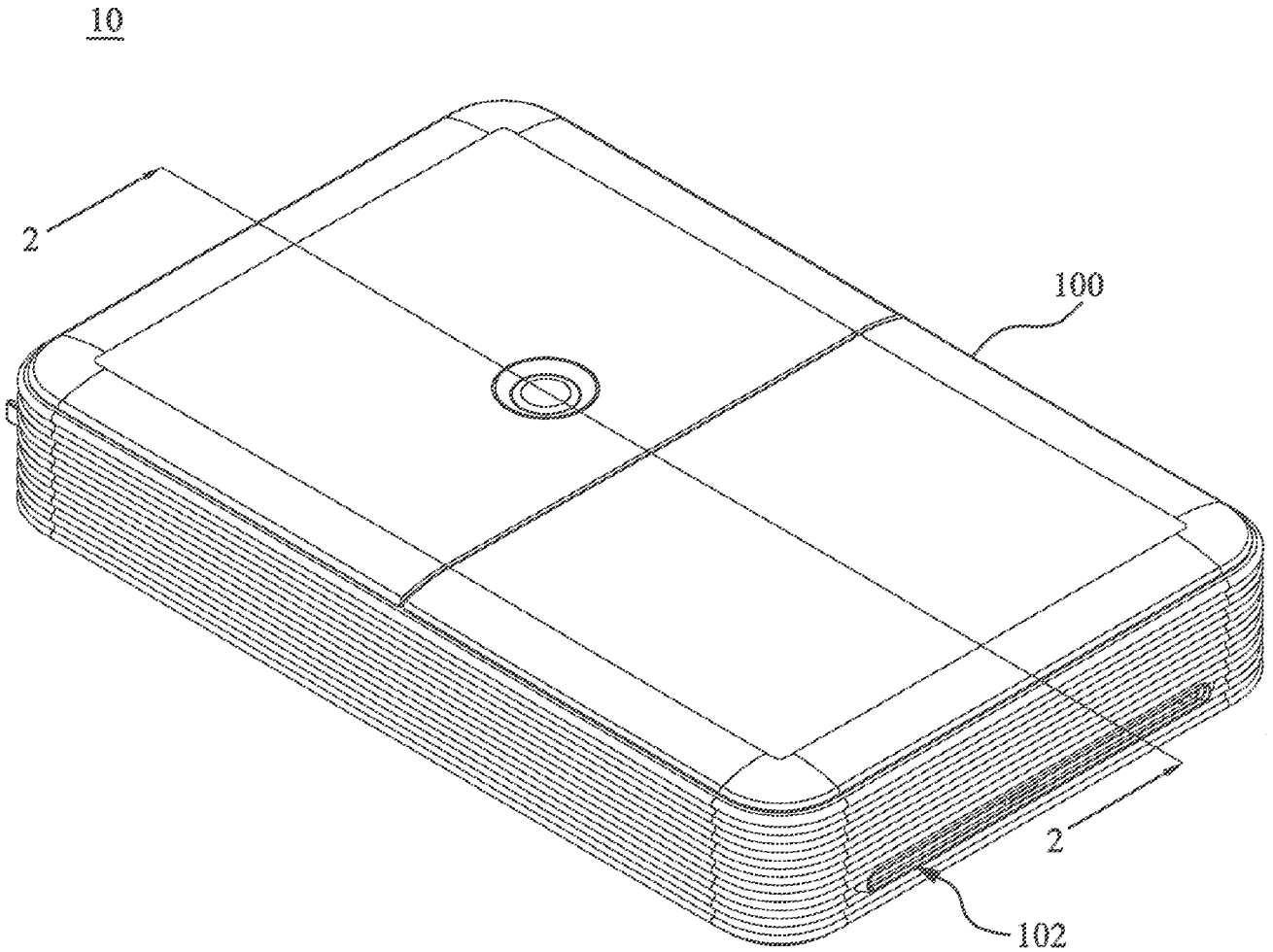
FIG. 1 is a perspective view of a sublimation printer according to an embodiment of the present disclosure.

The following embodiments are disclosed with accompanying diagrams for detailed description. For illustration clarity, many details of practice are explained in the following descriptions. However, it should be understood that these details of practice do not intend to limit the present invention. That is, these details of practice are not necessary in parts of embodiments of the present invention. Furthermore, for the simplification of the drawings, some of the conventional structures and elements are shown with schematic illustrations. Wherever possible, the same reference numbers are used in the drawings and the description to refer to the same or like parts.

The following embodiments disclose a sublimation printer for printing photos and can be carried with a user. More specifically, the sublimation printer of the following embodiments is thin and flat so that a user can easily carry and print photos immediately after capture.

Figure 2:
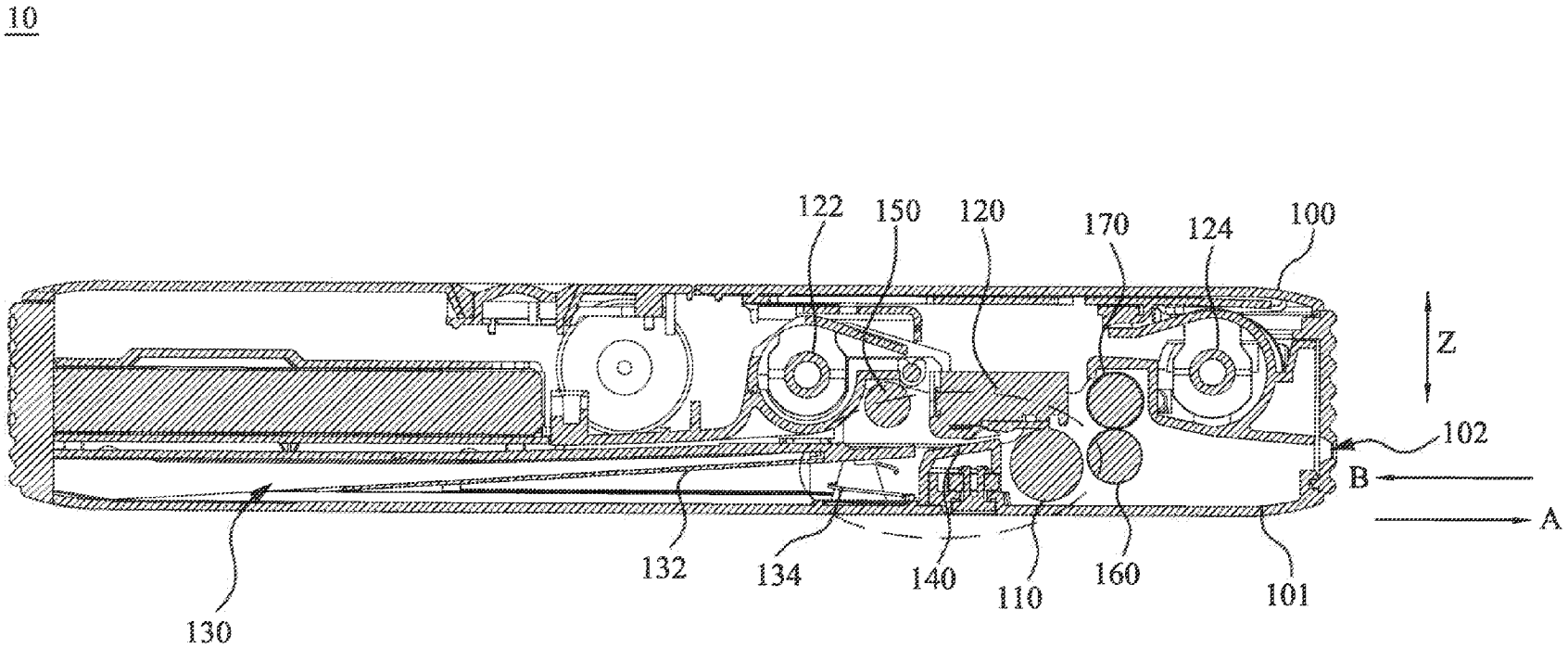
FIG. 2 is a cross-sectional view of FIG. 1 taken along line 2.

FIG. 1 is a perspective view of a sublimation printer 10 according to an embodiment of the present disclosure. FIG. 2 is a cross-sectional view of FIG. 1 taken along line 2. As illustrated in FIG. 1 and FIG. 2, the sublimation printer 10 of the present embodiment includes a casing 100, a platen roller 110, a thermal printing head 120 and a paper cassette 130, in which the platen roller 110, the thermal printing head 120 and the paper cassette 130 are disposed inside the casing 100. The paper cassette 130 is located on a side of the platen roller 110 and the thermal printing head 120 so that the sublimation printer 10 can be thin and flatness. More specifically, the thermal printing head 120 and the platen roller 110 are arranged along an altitude direction Z of the sublimation printer 10. Therefore, if the paper cassette 130 is also arranged along the altitude direction Z above or below the thermal printing head 120 or the platen roller 110, the thickness of the sublimation printer 10 will easily increase. As a result, the paper cassette 130 of the present embodiment is disposed on one side of the platen roller 110 and the thermal printing head 120 along a horizontal direction, and the arrangement direction of the paper cassette 130 and the platen roller 110 is substantially perpendicular to the altitude direction Z, so as to decrease the thickness of the sublimation printer 10.

With reference made to FIG. 1 and FIG. 2, in the present embodiment, the platen roller 110 is used to support a printing medium 200 (illustrated in FIG. 4 and FIG. 5) when the printing medium 200 moves along a first direction A or a second direction B, in which the printing medium 200 can be such as a photographic paper, but is not limited thereto. The first direction A and the second direction B are substantially opposite to each other, and the first direction A and the second direction B are substantially perpendicular to the altitude direction Z. The thermal printing head 120 and the platen roller 110 are disposed face-to-face. The thermal printing head 120 is used to transfer dyes of a ribbon 210 (illustrated in FIG. 4 and FIG. 5) onto the printing medium 200, in which the dyes transferring direction of the thermal printing head 120 is substantially the same with the altitude direction Z. The paper cassette 130 is located on one side of the platen roller 110 along the second direction B, and the paper cassette 130 is used to accommodate the printing media 200, in which along the first direction A or the second direction B, the orthogonal projection of the paper cassette 130 on the casing 100 at least partially overlaps with the orthogonal projection of the platen roller 110 on the casing 100. Briefly speaking, the paper cassette 130 and the platen roller 110 are horizontally arranged along the first direction A or the second direction B so that the entire sublimation printer 10 can be thin and flat.

In some embodiments, along the first direction A or the second direction B, the orthogonal projection of the paper cassette 130 on the casing 100 may mostly overlap with the orthogonal projection of the platen roller 110 on the casing 100, or the orthogonal projection of the paper cassette 130 on the casing 100 may fall within the orthogonal projection of the platen roller 110 on the casing 100, so as to decrease the length of the entire sublimation printer 10 along the altitude direction Z. Further, in some embodiments, the printing media 200 inside the paper cassette 130 may cancel its torn edges so that the length of the paper cassette 130 can also decrease, so as to reduce the length of the casing 100 of the sublimation printer 10 along the first direction A or the second direction B.

Figure 3:
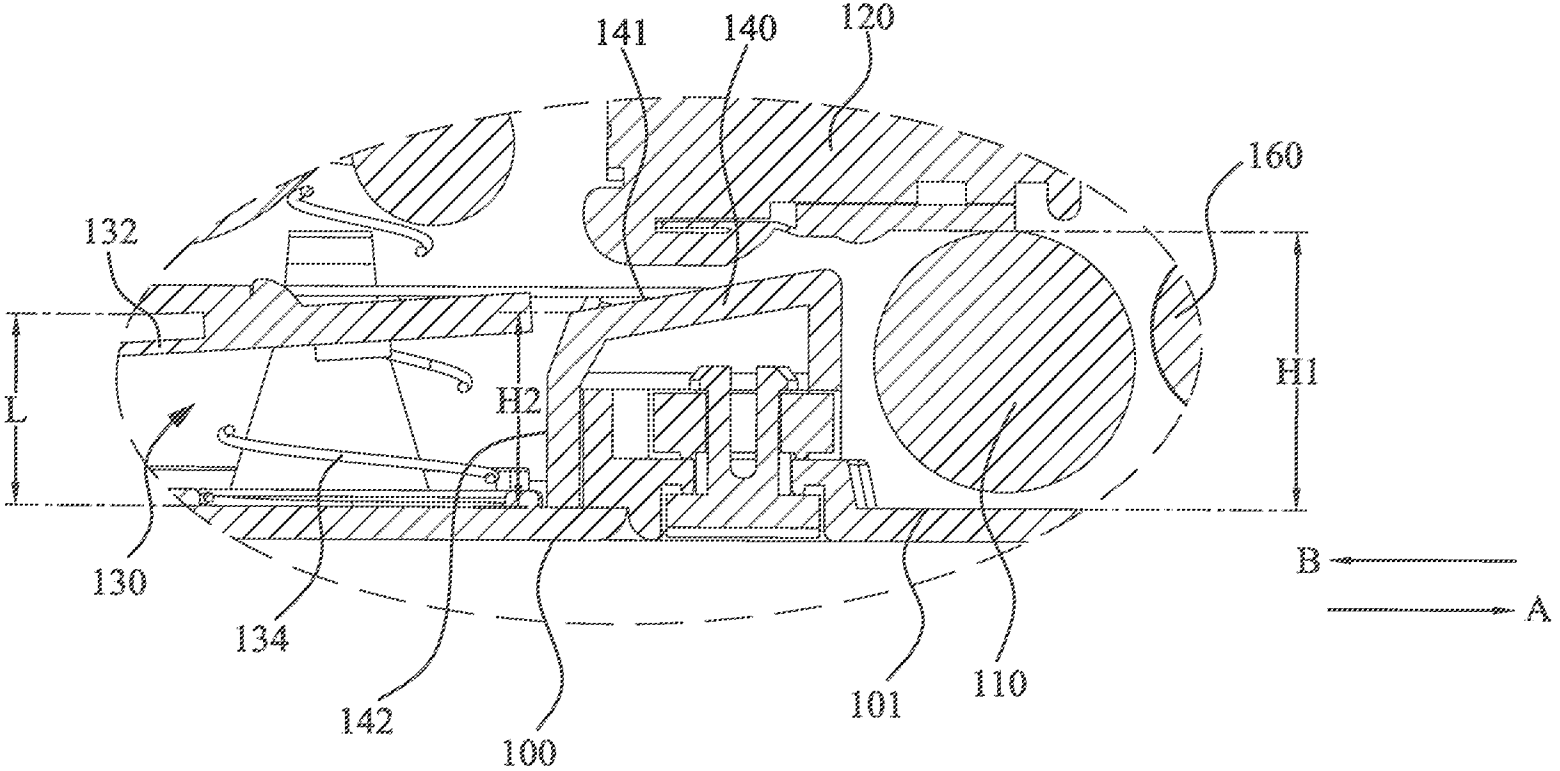
FIG. 3 is an enlarged view of the sublimation printer of FIG. 2.

FIG. 3 is an enlarged view of the sublimation printer 10 of FIG. 2. With reference made to FIG. 3, in some embodiments, the platen roller 110 is disposed adjacent to the bottom surface 101 of the casing 100, and the platen roller 110 has a first height H1 relative to the bottom surface 101. The first height H1 is greater than or equal to the height L of the paper cassette 130 relative to the bottom surface 101. More specifically, in some embodiments, the platen roller 110 is disposed on the bottom surface 101 of the casing 100, and the platen roller 110 does not directly contact with the bottom surface 101. There is a gap between the platen roller 110 and the bottom surface 101 of the casing 100. As a result, the platen roller 110 has a first height H1 relative to the bottom surface 101 of the casing 101, and the paper cassette 130 has the height L less than or equal to the first height H1 and is located on the second direction B of the platen roller 110 so that the paper cassette 130 does not make the length of the casing 100 increase along the altitude direction Z, which achieves the purpose of sublimation printer 10 being manufactured thin and flat.

With reference made to FIG. 2 and FIG. 3, in some embodiments, the sublimation printer 10 further includes a platform 140. The platform 140 is disposed inside the casing 100, and the platform 140 may disposed between the paper cassette 130 and the platen roller 110. The platform 140 is used to guide the printing medium 200 to move toward the direction from the paper cassette 130 to the platen roller 110. That is, the platform 140 guides the printing medium 200 to move along the first direction A, in which along the first direction A or the second direction B, the orthogonal projections of the platform 140, the platen roller 110 and the paper cassette 130 on the casing 100 at least partially overlap with each other. The paper cassette 130, the platform 140 and the platen roller 110 are horizontally arranged along the first direction A or the second direction B so that the appearance of the entire sublimation printer 10 can be thin and flat.

With reference made to FIG. 3, in some embodiments, the platform 140 is extended from a bottom surface 101 of the casing 100. A side of the platform 140 close to the paper cassette has a second height H2. The second height H2 is less than the height L of the paper cassette 130 so that the platform 140 does not increase the thickness of the casing 100, so as to achieve the purpose of manufacturing the thin and flat sublimation printer 10.

Furthermore, in some embodiments, the sublimation printer 10 further includes a pickup roller 150. The pickup roller 150 is disposed inside the casing 100, and the pickup roller 150 is contacted with the printing medium 200 to roll up the printing medium 200 toward the first direction A. In addition, after the pickup roller 150 rolls up the printing medium 200, the printing medium 200 immediately enters a position between the thermal printing head 120 and the platen roller 110 so that the printing medium 200 does not tend to be skewed due to the vibration or other possible accidental hits on the casing 100 during the movement of the printing medium 200.

With reference made to FIG. 2, along the first direction A or the second direction B, the orthogonal projections of the pickup roller 150 and the thermal printing head 120 on the casing 100 overlap with each other. Furthermore, in some embodiments, the orthogonal projection of the pickup roller 150 may overlap with the orthogonal projection of the thermal printing head 120 on the casing 100, or the orthogonal projection of the pickup roller 150 on the casing 100 may fall within the orthogonal projection of the thermal printing head 120 on the casing 100, so as to minimize the thickness of the sublimation printer 10. As a result, along the altitude direction Z, the thickness of the casing 100 of the sublimation printer 10 at least needs to accommodate the platen roller 110 and the thermal printing head 120, and there is no need to increase the thickness of the casing 100 to accommodate the pickup roller 150.

With reference made to FIG. 2, in some embodiments, the sublimation printer 10 further includes a capstan roller 160. The capstan roller 160 is disposed inside the casing 100, and the capstan roller 160 is located on a side of the platen roller 110 along the first direction A or the second direction B. Further, along the first direction A or the second direction B, the orthogonal projections of the capstan roller 160, the platen roller 110 and the paper cassette 130 on the casing 100 at least overlap with each other. The capstan roller 160, the platen roller 110 and the paper cassette 130 are horizontally arranged along the first direction A or the second direction B so that the appearance of the entire sublimation printer 10 can be thin and flatness.

In some embodiments, along the first direction A or the second direction B, the orthogonal projection of the capstan roller 160 on the casing 100 may mostly overlap with the orthogonal projection of the platen roller 110 on the casing 100, or the orthogonal projection of the capstan roller 160 on the casing 100 may fall within the orthogonal projection of the platen roller 110 on the casing 100, so as to minimize the thickness of the entire sublimation printer 10.

Figure 4:
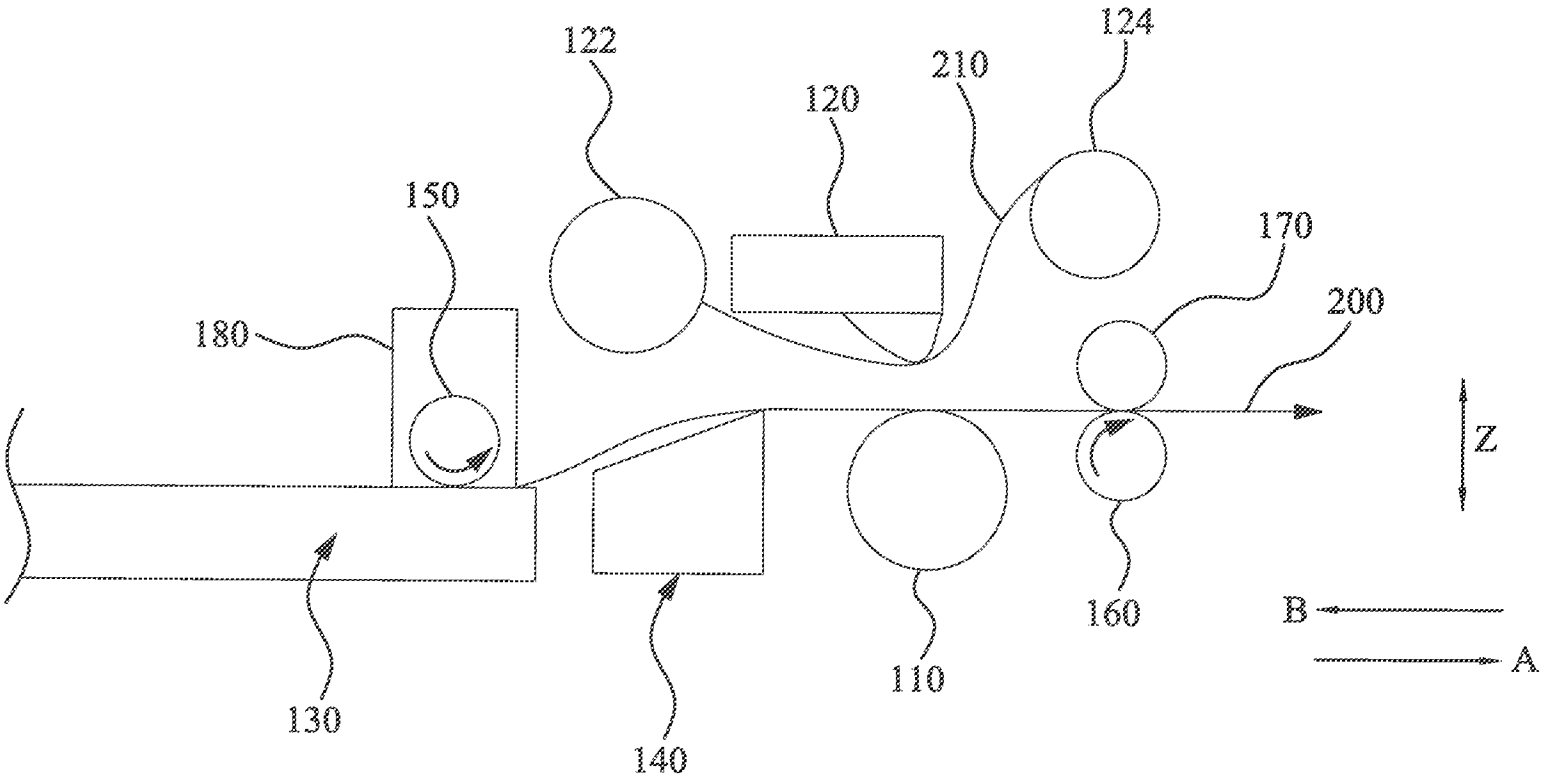
FIG. 4 is a schematic view of the printing medium moving along the first direction in accordance with an embodiment of the present disclosure.
Figure 5:
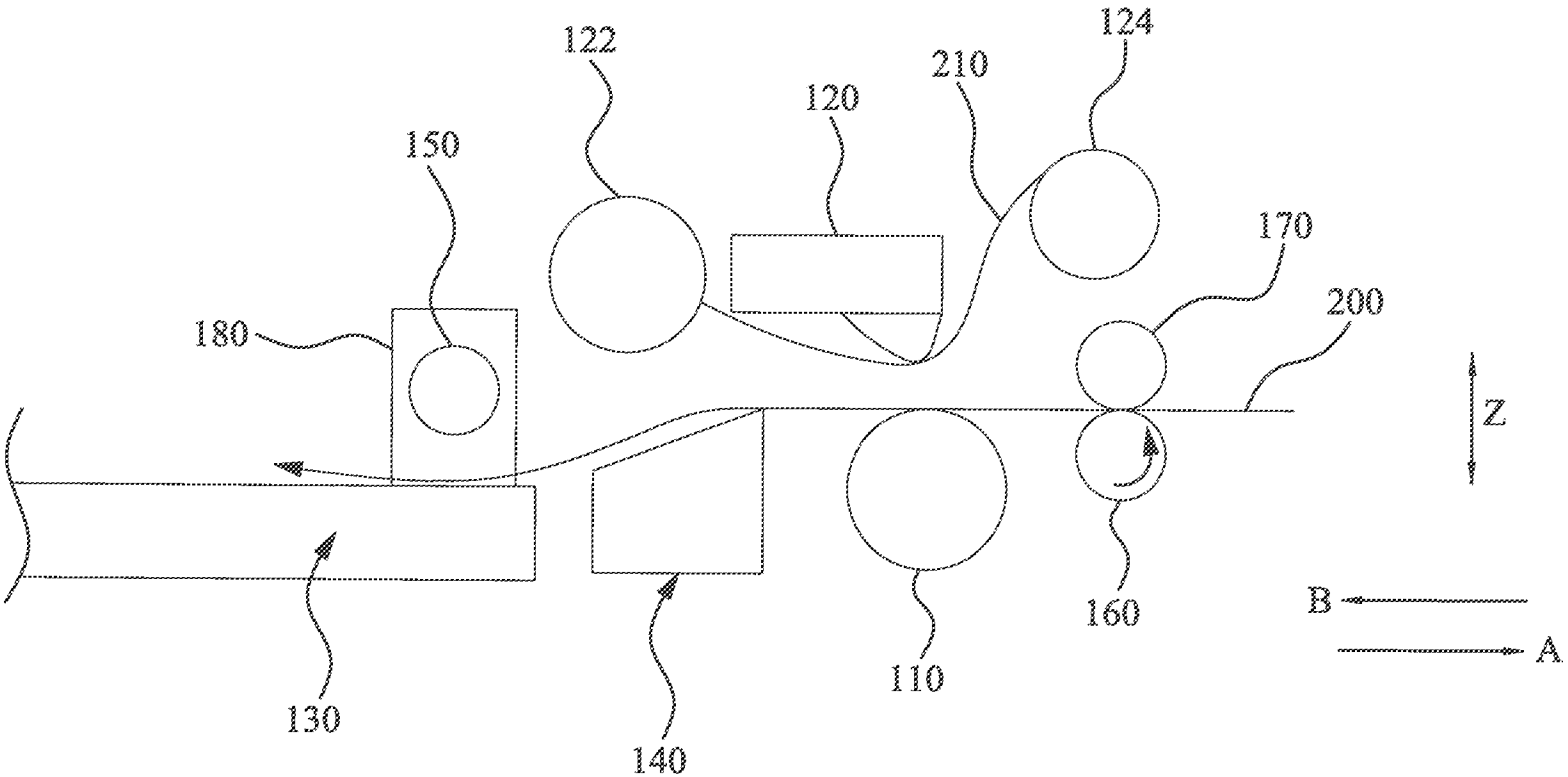
FIG. 5 is a schematic view of the printing medium moving along the second direction in accordance with an embodiment of the present disclosure.

With reference made to FIG. 2, FIG. 4 and FIG. 5, in which FIG. 4 is a schematic view of the printing medium 200 moving along the first direction A in accordance with an embodiment of the present disclosure, and FIG. 5 is a schematic view of the printing medium 200 moving along the second direction Bin accordance with an embodiment of the present disclosure. It should be understood that FIG. 4 and FIG. 5 only illustrated the motion of the rollers inside the casing 100 when the printing medium 200 moves along the first direction A or the second direction B. Therefore, the components inside the casing 100 are not illustrated according to practical proportion or position. As shown in FIG. 4 and FIG. 5, in some embodiments, the capstan roller 160 may selectively rotate clockwise or counterclockwise to make the printing medium 200 move along the first direction A or the second direction B. For example, when the capstan roller 160 rotates clockwise, the printing medium 200 moves toward the first direction A and output from the casing 100 through the paper exit slot 102. When the capstan roller 160 rotates counterclockwise, the printing medium 200 moves toward the second direction B and reenters the casing 100 through the paper exit slot 102.

To be more specific, in some embodiments, there is only one thermal printing head 120 inside the sublimation printer 10, only one color can be printed onto the printing medium 200 at one time. As a result, for performing the color printing, the printing medium 200 needs to be multiple printed by the sublimation printer 10. That is, after the sublimation printer 10 prints one color on the printing medium 200, the capstan roller 160 can rotate counterclockwise so that the printing medium 200 reenter the casing 100 from the capstan roller 160 to the position between the thermal printing head 120 and the platen roller 110, so as to perform the second printing operation.

With reference made to FIG. 2, FIG. 4 and FIG. 5, in some embodiments, to minimizing the thickness of the casing 100 of the sublimation printer 10, both pickup roller 150 and the paper cassette 130 are disposed on one side of the platen roller 110 along the second direction B. As a result, when the capstan roller 160 rotates counterclockwise, the platen roller 110 moves the printing medium 200 along the second direction B. In the meantime, the pickup roller 150 is separated from the printing medium 200, so as to avoid the pickup roller 150 affecting the printing medium 200 to move along the second direction B.

More specifically, in some embodiments, the sublimation printer 10 further includes a driving device 180 (illustrated in FIG. 4 and FIG. 5). The driving device 180 includes a motor. When the printing medium 200 moves along the second direction B, the driving device 180 drives the pickup roller 150 to move toward the altitude direction Z, so as to separate the pickup roller 150 from the printing medium 200.

With reference made to FIG. 2, in some embodiments, the sublimation printer 10 further includes a pinch roller 170. The pinch roller 170 is disposed inside the casing 100, and the pinch roller 170 is located on one side of the thermal printing head 170 along the first direction A. The pinch roller 170 abuts the printing medium 200 against the capstan roller 160, so as to assist the capstan roller 160 to move the printing medium 200 along the first direction A or the second direction B. In practical application, there are a plenty of bumps on the surface of the pinch roller 170, so as to firmly abut the printing medium 200 against the capstan roller 160. Further, along the first direction A or the second direction B, the orthogonal projections of the pinch roller 170 and the thermal printing head 120 on the casing 100 at least partially overlap with each other. More specifically, the pinch roller 170, the capstan roller 150 and the thermal printing head 120 are arranged horizontally along the first direction A or the second direction B so that the appearance of the entire sublimation printer 10 can be thin and flatness.

In some embodiments, along the first direction A or the second direction B, the orthogonal projection of the pinch roller 170 on the casing 100 may at least partially overlap with the orthogonal projection of the thermal printing head 120 on the casing 100, or the orthogonal projection of the pinch roller 170 on the casing 100 may fall within the orthogonal projection of the thermal printing head 120 on the casing 100, so as to minimize the thickness of the sublimation printer 10. As a result, the thickness (the length along the altitude direction Z) of the casing 10 at least needs to accommodate the platen roller 110 and the thermal printing head 120, and there are no needs to increase the thickness of the casing 100 to accommodate the pinch roller 170.

With reference made to FIG. 2, in some embodiments, the ribbon 210 has a relative movement with the thermal printing head 120 through a ribbon transmission mechanism, The ribbon transmission mechanism may include a ribbon feeding reel 122 and a ribbon receiving reel 124. The ribbon feeding reel 122 includes the ribbon 210 which has not been used yet, and the ribbon receiving reel 124 is used to receive the ribbon that has been used. Further, to minimizing the thickness of the casing 100, the position of the ribbon feeding reel 122 is located on one side of the thermal printing head 120 along the second direction B, and the position of the ribbon receiving reel 124 is located on another side of the thermal printing head 120 along the first direction A. In addition, along the first direction A or the second direction B, the orthogonal projections of the ribbon feeding reel 122, the pickup roller 150, the thermal printing head 120, the pinch roller 170 and the ribbon receiving reel 124 on the casing 100 at least partially overlap with each other, so as to decrease the thickness of the casing 100. To minimizing the number of components inside the casing 100, two opposing ends of the ribbon feeding reel 122 and the ribbon receiving reel 124 can be designed with a flexible structure, so as to enhance the stability while the ribbon feeding reel 122 and the ribbon receiving reel 124 rotate, and thus, the casing 100 does not need an additional component for enhancing the stability of the ribbon feeding reel 122 and the ribbon receiving reel 124 while rotating.

In some embodiments, when the thermal printing head 120 transfers the dyes of the ribbon 210 onto the printing medium 200, because the platen roller 110 is a base of the printing medium 200, the platen roller 110 needs to be a predetermined size, so as to avoid affecting the quality of printing. Therefore, the size of the platen roller 110 is larger than other rollers. More specifically, except the platen roller 100, the components inside the casing 100 can be minimized and be disposed on two sides of the platen roller 110 along the first direction A or the second direction B, so as to decrease the thickness of the casing 100.

In other words, with reference made to FIG. 2, the cross-sectional area of the platen roller 110 is greater than each of the cross-sectional areas of the pickup roller 150, the ribbon feeding reel 122, the ribbon receiving reel 124, the capstan roller 160 and the pinch roller 170. More specifically, in some embodiments, the cross-section of the platen roller 110, the pickup roller 150, the ribbon feeding reel 122, the ribbon receiving reel 124, the capstan roller 160 and the pinch roller 170 are substantially in a circular shape, and the diameter of the platen roller 110 is larger than other rollers, so as to maintain the printing quality. Further, through the increased diameter of the platen roller 110, the paper cassette 130, the platform 140 and the capstan roller 160 can be disposed on two sides of the platen roller 110 along the first direction A or the second direction B, so as to decrease the thickness of the casing 100.

With reference made to FIG. 2, in some embodiments, the paper cassette 130 further includes an elastic slice 132. The elastic slice 132 can abut against the printing medium 200 along a direction toward the pickup roller 150. Thus, when the pickup roller 150 rolls up the printing medium 200, the paper cassette 130 automatically provides the next printing medium 200 to contact with the pickup roller 150 and assists the pickup roller 150 to roll up the printing medium 200. Since there is no need to set an additional component inside the casing 100 to assist the pickup roller 150 to roil up the printing medium 200, the components inside the casing 100 can be reduced, so as to achieve the purpose of manufacturing the thin and flat sublimation printer 10.

In some embodiments, the paper cassette 130 further includes an elastic member 134, and the elastic member 134 can be such as a compression spring, but is not limited thereto. The elastic member 134 can fix the elastic slice 132 in an expanding position. As illustrated in FIG. 3, if there is no printing media 200 inside the paper cassette 130, the elastic slice 132 is located on the expanding position, and in the meantime, the elastic slice 132 is aligned with the top portion 141 of the platform 140. As a result, the present embodiment can make sure that the last printing medium 200 inside the paper cassette 130 can be picked by the pickup roller 150 and moves along the first direction A without blocking by the platform 140.

More specifically, since the second height H2 of one side of the platform 140 dose to the paper cassette 130 is less than the height L of the paper cassette 130, the face of the platform 140 close to the paper cassette 130 can be acted as a stop wall 142. The stop wall 142 can stop the printing media 200 inside the paper cassette 130 so that at one time, there is only one printing medium 200 passes through the top portion 141 of the platform 140. Further, when the pickup roller 150 rolls up the printing medium 200, other printing media 200 can be stopped by the stop wall 142 so that the pickup roller 150 can only roll up one printing medium 200 at one time.

In some embodiments, the sublimation printer 10 can be selectively combined with different functional modules, such as a paper flipping module, a computer module, a laser cutting module and a mold punching module, so as to expand the operation function of the sublimation printer 10. More specifically, the paper flipping module can be disposed on the paper exit slot 102 so that the sublimation printer 10 can perform the double printing function on the printing media 200. The computer module can be electrically connected with the sublimation printer 10 so that the user can print the photos through directly choosing pictures stored in the computer or retouching the pictures that need to be printed. The laser cutting module can be disposed on the paper exit slot 102 of the casing 100 so that the printing medium 200 can be cut into a desired shape after finishing printing by the sublimation printer 10. The mold punching module can be disposed on the paper exit slot 102 of the casing 100 so that after finishing printing, the printing media 200 can be further processed, such as to punch or to press the printing media 200 to form different patterns on the printing media 200.

As discussed above, the pickup roller, the paper cassette, the platform, the capstan roller, the ribbon feeding roller, the ribbon receiving roller and the pinch roller are disposed on two sides of the platen roller horizontally, so that the thickness of the sublimation printer can be reduced. That is, in some embodiments, the thickness of the casing only needs to accommodate the platen roller and the thermal printing head, and there are no needs for increasing the thickness of the casing to accommodate the pickup roller, the paper cassette, the platform, the capstan roller, the ribbon feeding roller, the ribbon receiving roller and the pinch roller.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A sublimation printer, comprising:

a casing;

a platen roller disposed inside the casing and configured to support a printing medium when the printing medium moves along a first direction or a second direction, wherein the first direction is opposite to the second direction;

a thermal printing head disposed inside the casing and facing the platen roller, wherein the thermal printing head is configured to transfer dyes of a ribbon onto the printing medium;

a paper cassette disposed inside the casing and located on a side of the platen roller along the second direction, wherein the paper cassette is configured to accommodate the printing medium and an orthogonal projection of the paper cassette on the casing at least partially overlaps with an orthogonal projection of the platen roller on the casing along the first direction or the second direction; and a platform disposed inside the casing and located between the paper cassette and the platen roller, wherein the platform is configured to guide the printing medium to move along a direction from the paper cassette to the platen roller, and along the first direction or the second direction, the orthogonal projections of the platform, the platen roller and the cassette on the casing at least partially overlap with each other, wherein the platform is extended from a bottom surface of the casing, and a side of the platform close to the paper cassette has a second height which is less than a height of the paper cassette.

2. The sublimation printer of claim 1, wherein the platen roller is disposed adjacent to a bottom surface of the casing, and the platen roller has a first height which is greater than or equal to a height of the paper cassette.

3. The sublimation printer of claim 1, further comprising a pickup roller disposed inside the casing and contacted with the printing medium to roll up the printing medium toward the first direction, wherein along the first direction or the second direction, the orthogonal projections of the pickup roller and the thermal printing head on the casing at least partially overlap with each other.

4. The sublimation printer of claim 3, wherein when the printing medium moves along the second direction, the pickup roller is separated from the printing medium.

5. The sublimation printer of claim 3, wherein the paper cassette further comprises an elastic slice abutting against the printing medium along a direction toward the pickup roller.

6. The sublimation printer of claim 5, further comprising a platform disposed between the paper cassette and the platen roller, wherein when the elastic slice is at an expanding position, the elastic slice is aligned with a top portion of the platform.

7. The sublimation printer of claim 1, further comprising a capstan roller disposed inside the casing, the capstan roller located on a side of the platen roller along the first direction, and the capstan roller selectively rotated clockwise or counterclockwise so that the printing medium moves along the first direction or the second direction, wherein along the first direction or the second direction, the orthogonal projections of the capstan roller, the platen roller and the paper cassette on the casing at least partially overlap with each other.

8. The sublimation printer of claim 7, further comprising a pinch roller disposed inside the casing, the pinch roller located on a side of the thermal printing head along the first direction, and the pinch roller configured to make the printing medium abut against the capstan roller, wherein along the first direction or the second direction, the orthogonal projections of the pinch roller and the thermal printing head on the casing at least partially overlap with each other.

* * * * *